US005724897A

United States Patent [19]

Breen et al.

[11] Patent Number: 5,724,897

[45] Date of Patent: Mar. 10, 1998

[54] SPLIT FLAME BURNER FOR REDUCING $NO_x$ FORMATION

[75] Inventors: Bernard P. Breen, Pittsburgh; John P. Bionda, Coraopolis, both of Pa.; James E. Gabrielson, Plymouth, Minn.; Anthony Hallo, Springdale, Pa.

[73] Assignees: Duquesne Light Company; Energy Systems Associates, both of Pittsburgh, Pa.

[21] Appl. No.: 738,742

[22] Filed: Oct. 28, 1996

Related U.S. Application Data

[63] Continuation-in-part of Ser. No. 359,800, Dec. 20, 1994, Pat. No. 5,568,777.

[51] Int. Cl.[6] ..... F23C 1/10

[52] U.S. Cl. ..... 110/261; 110/265; 110/347

[58] Field of Search ..... 110/260, 261, 110/263, 265, 347; 431/8, 10, 181, 186, 187, 350, 351

[56] References Cited

U.S. PATENT DOCUMENTS

| | | |
|---|---|---|
| 4,223,615 | 9/1980 | Breen . |
| 4,348,170 | 9/1982 | Vatsky et al. . |
| 4,428,727 | 1/1984 | Deussner et al. . |
| 4,899,670 | 2/1990 | Hansel . |
| 4,930,430 | 6/1990 | Allen et al. . |
| 4,951,581 | 8/1990 | Wiest . |
| 5,020,454 | 6/1991 | Hellewell et al. . |
| 5,048,433 | 9/1991 | Green et al. . |
| 5,113,771 | 5/1992 | Rini et al. . |
| 5,231,937 | 8/1993 | Kobayashi et al. . |
| 5,249,535 | 10/1993 | Chung . |
| 5,347,937 | 9/1994 | Vatsky . |

FOREIGN PATENT DOCUMENTS

| | | |
|---|---|---|
| 0073305 | 5/1992 | Japan . |
| 1079948 | 3/1984 | U.S.S.R. . |
| 1573299 | 6/1990 | U.S.S.R. . |
| 334755 | 9/1930 | United Kingdom . |

*Primary Examiner*—Henry A. Bennett
*Assistant Examiner*—Pamela A. O'Connor
*Attorney, Agent, or Firm*—Dickie, McCamey & Chilcote, P.C.; Leland P. Schermer; John N. Cox

[57] ABSTRACT

An improved pulverized coal burner that reduces the formation of nitrogen oxides. The coal burner includes fuel splitters that separate a mixture of primary air and coal into a plurality of streams while the mixture is discharged through a diffuser having a plurality of partially open areas and a plurality of blocked areas. After passing through the diffuser, the plurality of streams are discharged into a furnace to be burned. The plurality of partially open areas and blocked areas are created by removing sections of the diffuser and replacing the removed sections with fuel spiders. Creation of these discrete streams delays mixing with secondary air. Because primary air is supplied in substoichiometric quantities, the coal in these split streams will be burned under fuel-rich conditions for the first 100 to 200 milliseconds of combustion, until the delayed mixing of secondary air occurs. Combustion in a fuel-rich environment retards formation of nitrogen oxides in two ways. First, nitrogen that is part of the volatile matter that is evolved during the ears stages of combustion will tend to form molecular nitrogen rather than react with oxygen to form nitrogen oxides. Second, an oxygen deficiency will reduce formation of nitrogen oxides from atmospheric nitrogen. Two variations of bypass conduits are disclosed that allow a portion of the mixture of primary air and coal to bypass the diffuser and discharge into the furnace.

4 Claims, 8 Drawing Sheets

Example 1 Results

| Overfire Air Damper Position (% Open) | Nitric Oxide (lbs/mmBTU) | Carbon Monoxide (ppmv @ 3% $O_2$) | Combustibles in Fly Ash (%) |
|---|---|---|---|
| 35 | 0.72 | 22 | 9.4 |
| 55 | 0.69 | 20 | 11.3 |
| 75 | 0.67 | 23 | N/A |
| 100 | 0.56 | 24 | N/A |

FIG. 5

Example 2 Results

| Overfire Air Damper Position (% Open) | Nitric Oxide (lbs/mmBTU) | Carbon Monoxide (ppmv @ 3% $O_2$) | Combustibles in Fly Ash (%) |
|---|---|---|---|
| 35 | 0.58 | 50 | 7.5 |
| 55 | 0.55 | 55 | 8.7 |
| 75 | 0.45 | 56 | N/A |

FIG. 6

SPLIT FLAME BURNER FOR REDUCING $NO_X$ FORMATION

CROSS-REFERENCE TO RELATED APPLICATION

This application is a continuation-in-part of U.S. application Ser. No. 08/359,800, filed on Dec. 20, 1994 now U.S. Pat. No. 5,568,777.

BACKGROUND OF THE INVENTION

1. Field of the Invention

The present invention relates to an improved coal burner that reduces the formation of nitrogen oxides in pulverized coal-fired furnaces. More specifically, the present invention relates to an apparatus and method that use diffusers in connection with coal burners so that the flow of primary air and coal is split into two or more discrete streams before being discharged into the furnace. The present invention also relates to a method for forming a plurality of discrete streams leaving the primary-air/coal pipe.

2. Description of the Prior Art

Empirical studies have identified two mechanisms for the formation of nitrogen oxides, hereinafter referred to as NOx, in pulverized coal/air flames: (1) thermal reaction of nitrogen and oxygen contained within combustion air to form NOx (hereinafter thermal NOx), and (2) the oxidation of organically bound nitrogen compounds contained within coal to NOx (hereinafter fuel NOx). For conventional furnaces, thermal NOx formation becomes significant at temperatures above 2800 degrees Fahrenheit. Conversion of fuel-bound nitrogen to NOx can occur at much lower temperatures. Fuel-bound nitrogen is believed to be the source of about 75% of the total NOx resulting from combustion of pulverized coal.

The content of nitrogen by weight of coals typically burned by utilities can vary from about 0.3% to over 2.0%. A coal having 1% nitrogen by weight and a heating value of 12,000 Btu per pound would emit the equivalent of more than 0.5 pounds of NOx per million Btu's if only 20% of the fuel-bound nitrogen was converted to NOx.

Fuel NOx is produced by the oxidation of nitrogen that is present in both the volatile matter and char portions of coal. However, investigations have revealed that approximately 60 to 80 percent of the fuel NOx is produced by the oxidation of nitrogen present in the volatile matter. Volatile matter in coal is evolved during the first 200 milliseconds of combustion. Thus, by controlling the near-burner stoichiometry, fuel NOx formation rates can be reduced by creating localized oxygen deficient regions early in the combustion process when near-adiabatic conditions exist. Additionally, creating a localized oxygen deficiency at the location of the peak flame temperature reduces the formation of thermal NOx. Therefore, controlling the near burner stoichiometry is an effective method of reducing thermal and fuel NOx formation.

Slowly mixing or controlled mixing burners have been tried on wall-fired furnaces. These slow mixing burners may have two sets of registers to control secondary combustion air flow. However, two sets of registers increases the cost of producing the burners. They have had some success but are expensive and often result in increased unburned carbon in the fly ash. Excessive levels of unburned carbon in fly ash is an indication of poor combustion efficiency and is measured by determining the weight loss on ignition of fly ash. Excessive carbon in fly ash also decreases the fly ash's value as an additive for Portland cement, which is its most profitable use. Additionally, if the amount of unburned carbon in the fly ash becomes too high, then fly ash is susceptible to combustion and the resulting fires can damage power plant equipment and facilities.

These slow mixing burners may also cause flame impingement on the boiler tubes which increases corrosion and erosion of tube metal and decreases tube life. The impingement can also cause severe slagging problems. In the extreme, the flame impingement can cause tube wastage so extensive that in a matter of a few days or weeks, the furnace is forced off-line to repair or replace damaged tubes. Slow mixing can also cause elevated furnace exit temperatures which can cause severe fouling. Fouling can become so bad that the unit must be taken off line to clean the heat transfer surfaces.

Slow mixing burners often do not decrease the formation of NOx as far as desired by themselves. Therefore, they are often used in conjunction with overfire air ports. The use of overfire air ports is common in the application of this technology because overfire air is a more effective NOx reduction technique than the burners. Sometimes, overfire air ports can by themselves or in conjunction with low NOx burners reduce the NOx emissions to desired levels. However, overfire air ports are expensive and can also cause many of the problems associated with the slow mixing burners. In addition, using overfire air ports can convert the entire lower part of the furnace into a fuel rich zone and create a reducing atmosphere. Reducing conditions can lead to rapid or catastrophic deterioration of boiler tube metal. This can lead to boiler tube failure in a short period of time.

Other retrofits include reburn, wherein some fuel is added to the furnace after most of the coal has burned in order to produce a fuel rich zone. After the fuel rich zone is formed, more air is injected. This technique is promising, but it is only partially developed and is known to be expensive. Also, some furnaces simply do not have sufficient furnace volume to accommodate reburn systems. In addition, reburn is most effective if the reburn fuel does not contain any fixed nitrogen. However, fuels that do not contain fixed nitrogen are usually more expensive than coal or heavy oil.

Using ammonia to react with the NOx to form molecular nitrogen has been successful in special applications. However, thermal or catalytic reduction of NOx with ammonia is expensive. Also, ammonia will react with any sulfur trioxide that is present to form a sticky solid or viscous fluid that can plug air heaters or form visible emissions. Further, any un-reacted ammonia may pass through pollution control equipment and escape into the environment. Even if an ammonia based NOx reduction system is used to obtain very low emissions it would still be desirable to reduce the formation of NOx during combustion to reduce the size and cost of any post-combustion NOx control system.

Breen, U.S. Pat. No. 4,223,615, discloses a process for placing aerodynamic spoilers that extend into the wake of the stream of primary air and pulverized coal to produce fuel-rich and air-rich zones near the burner. The technology disclosed by Breen would not be effective on burners with diffusers, because a downstream diffuser would break up the separate streams formed by the aerodynamic spoilers.

Chung, U.S. Pat. No. 5,249,535, discloses a burner tip that divides an annular pulverized coal stream into alternating fuel-rich and fuel-lean streams by means of skewed vanes that provide alternating converging and diverging channels for the primary-air and coal stream to flow through. The technology disclosed by Chung represents a complete replacement of a burner rather man a modification of an existing burner.

Rini, et al., U.S. Pat. No. 5,113,771, discloses the use of a nozzle that forms a plurality of passages for splitting the stream of primary air and pulverized coal into a corresponding plurality of separate streams. The passages are inclined and converge such that the plurality of separate streams impinge upon each other upon being discharged into the primary burn zone of the furnace.

Allen, et al., U.S. Pat. No. 4,930,430, discloses the use of guide elements and flow disturbing members arranged to deflect the flow of primary air and coal in the primary-air/coal pipe to produce regions of high fuel concentration. The action of the guide elements and flow disturbing members promotes combustion conditions that lead to low NOx emissions.

Vatsky, U.S. Pat. No. 5,347,937, discloses a plurality of angularly spaced walls within an annular passage that is part of a burner assembly for splitting up a fuel/air stream so that upon ignition of said fuel a plurality of flame patterns are formed.

Vatsky, U.S. Pat. No. 4,348,170 discloses a plurality of V-shaped members disposed within an annular passage located in a burner assembly for splitting up stream of fuel so that, upon ignition of the fuel, a plurality of flame patterns are formed.

Despite the efforts of others described above, there remains a long-felt need for an effective, relatively inexpensive retrofit scheme that reduces NOx formation in pulverized coal-fired furnaces that utilize coal burners with diffusers.

SUMMARY OF THE INVENTION

The apparatus and method of the present invention create a modified coal burner that uses a diffuser and fuel splitters in order to reduce NOx in pulverized coal-fired furnaces. One component of the coal burner is a primary-air/coal pipe that transports a mixture of primary air and pulverized coal from the pulverizer to the furnace. A diffuser is placed on the primary-air/coal pipe where a mixture of air and pulverized coal is discharged into the furnace. The center of the diffuser is attached to a connecting rod that runs along the center axis of the primary-air/coal pipe. In a preferred embodiment, the diffuser comprises a plurality of concentric circular rings, each of which is shaped like a section of a cone and has its center located on a central longitudinal axis of the primary-air/coal pipe. The surface of each ring is angled to deflect the stream of air and pulverized coal passing through the diffuser in an outward direction away from the center points of the circular rings.

In the present invention, a plurality of sections of the diffuser are removed and are replaced with blocking means so that the mixture of air and coal is split into separate streams and the streams flow into a plurality of open sections of the diffuser. On the preferred embodiment, each blocked means is an aerodynamic fuel splitter that separates the mixture of air and coal into a plurality of separate streams. Sides of adjacent fuel splitters form a channel that directs each stream into an open section. In one embodiment, both the diffuser and the cross-sectional area of the air/coal pipe are circular, and both the blocked and open areas of the diffuser are sectors of a circle. In one embodiment, the leading edge of the fuel splitter is a sharp edge in which the end of the sharp edge closest to the wall of the air/coal pipe extends further upstream than the end of the sharp edge closest to the center line of the coal/air pipe. In one embodiment, the trailing edge of the fuel splitter is shaped to allow the smooth flow of secondary air on the downstream side of the blocked sections of the diffuser.

By directing a flow of primary air and coal into a plurality of open sectors of the diffuser, a plurality of discrete streams or combustion zones are formed in the furnace. By dividing the mixture of air and coal into a plurality of streams, mixing with secondary air is delayed and the initial stages of combustion are carried out in a fuel rich environment which limits the formation of NOx. To insure the coal portion of the flow of primary air and coal is not unduly concentrated towards the center of the diffuser by the splitters, a venturi spreader can be located on the connecting rod, which runs along the central axis of the coal/air pipe. This venturi spreader deflects the portion of the mixture of air and coal nearest the central axis of the coal/air pipe in an outward direction. This outward deflection counters the tendency of the fuel splitters to deflect the coal portion of the mixture of air and coal toward the center of the diffuser.

Because primary air is supplied in sub-stoichiometric quantities, the coal in these streams will be burned under sub-stoichiometric conditions for the first 100 to 200 milliseconds of combustion. The lack of oxygen that is characteristic of substoichiometric conditions retards formation of nitrogen oxides in two ways. First, nitrogen that is part of the volatile matter that is evolved during the early stages of combustion will form molecular nitrogen rather than react with oxygen to form nitrogen oxides. Second, an oxygen deficiency will reduce formation of thermal nitrogen oxides from atmospheric nitrogen.

Two additional alternatives of this invention involve the used of bypass conduits that lead from the leading edge of the fuel splitters to the trailing edge of the fuel splitters. These bypass conduits allow some of the mixture of primary air and pulverized coal to pass through the fuel splitter, rather than be diverted to the plurality of open sections of the diffuser. There are two reasons for allowing a portion of the primary air and pulverized coal to pass through conduits in the fuel splitters. First, allowing some of the primary air and pulverized coal to pass directly through the fuel splitter in conduits reduces the volume of primary air and pulverized coal that passes through the open sections of the diffuser. This reduction in volume reduces the velocity of the primary air and pulverized coal. The reduction in velocity reduces the rate at which the primary air and pulverized coal erodes the open sections of the diffuser. Second, allowing some of the primary air and coal to pass directly through the fuel splitters in conduits disrupts the formation of stationary eddies of secondary air which may form on the trailing edge of the fuel splitters. The formation of stationary eddies of secondary air on the trailing edge of the fuel splitters creates an oxygen rich combustion zone in which conditions for NOx formation are favorable.

Accordingly, it is an object of the present invention to provide an apparatus and method for reducing the formation of NOx in pulverized coal-fired furnaces that comprises a simple modification of burners by using diffusers and fuel splitters rather than replacing an entire burner. Another object of the present invention is to create conditions that retard the formation of NOx without creating long flames that impinge upon boiler tubes. Still another object of the present invention is to avoid creation of large areas in the furnace where a reducing atmosphere exists. Yet another object of the present invention is to reduce the formation of NOx during combustion without causing the occurrence of excessive unburned carbon in the fly ash or excessive CO in the flue gas.

These and other advantages and features of the present invention will be more fully understood by reference to the detailed description and drawings of this specification.

BRIEF DESCRIPTION OF THE DRAWINGS

FIG. 5 contains results from a baseline test not employing the present invention.

FIG. 6 contains results from tests with the improved coal burner.

DETAILED DESCRIPTION OF THE PREFERRED EMBODIMENT

Figure 1:
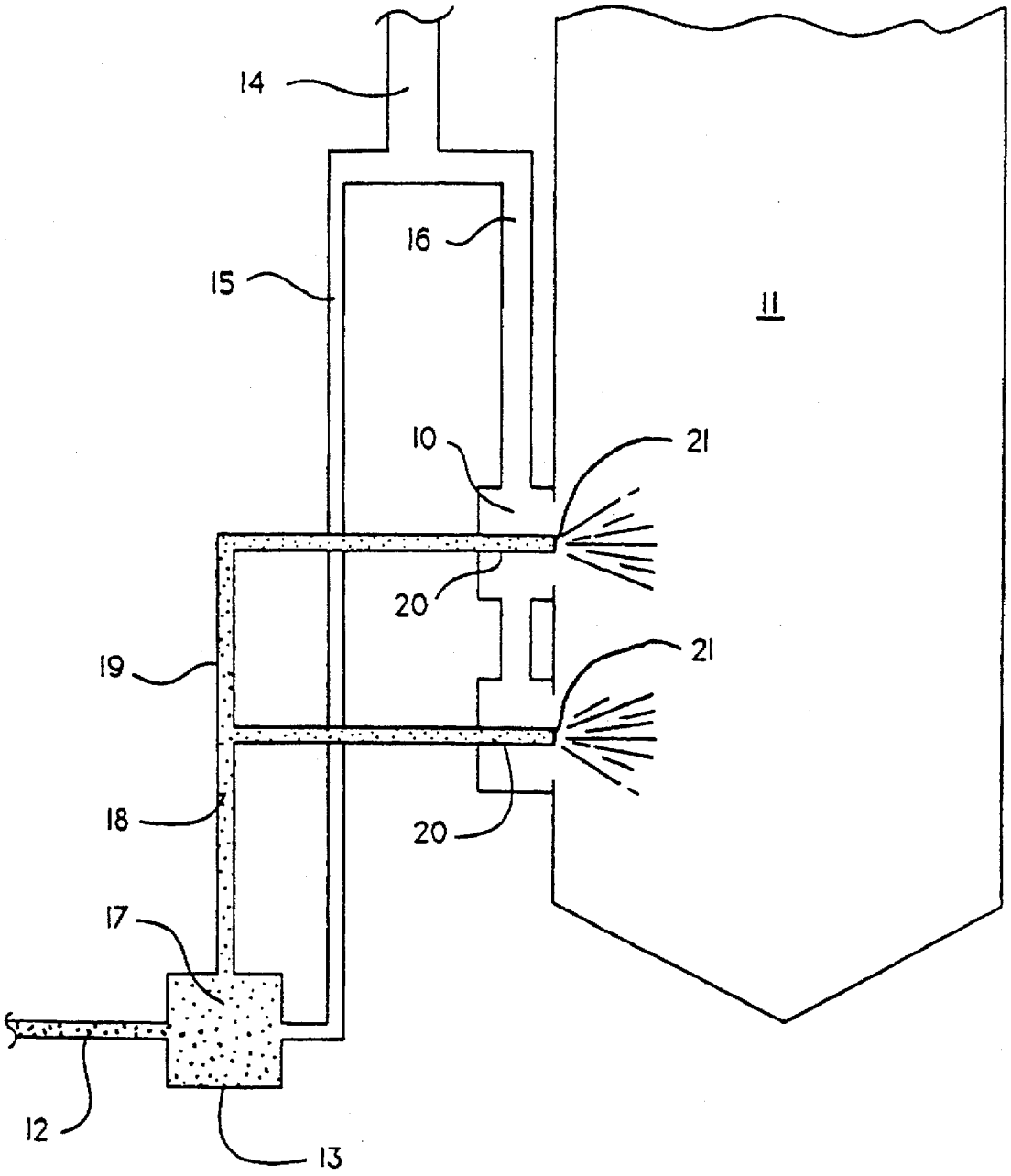
FIG. 1 is a schematic overview of a typical pulverized coal combustion system.
Figure 2:
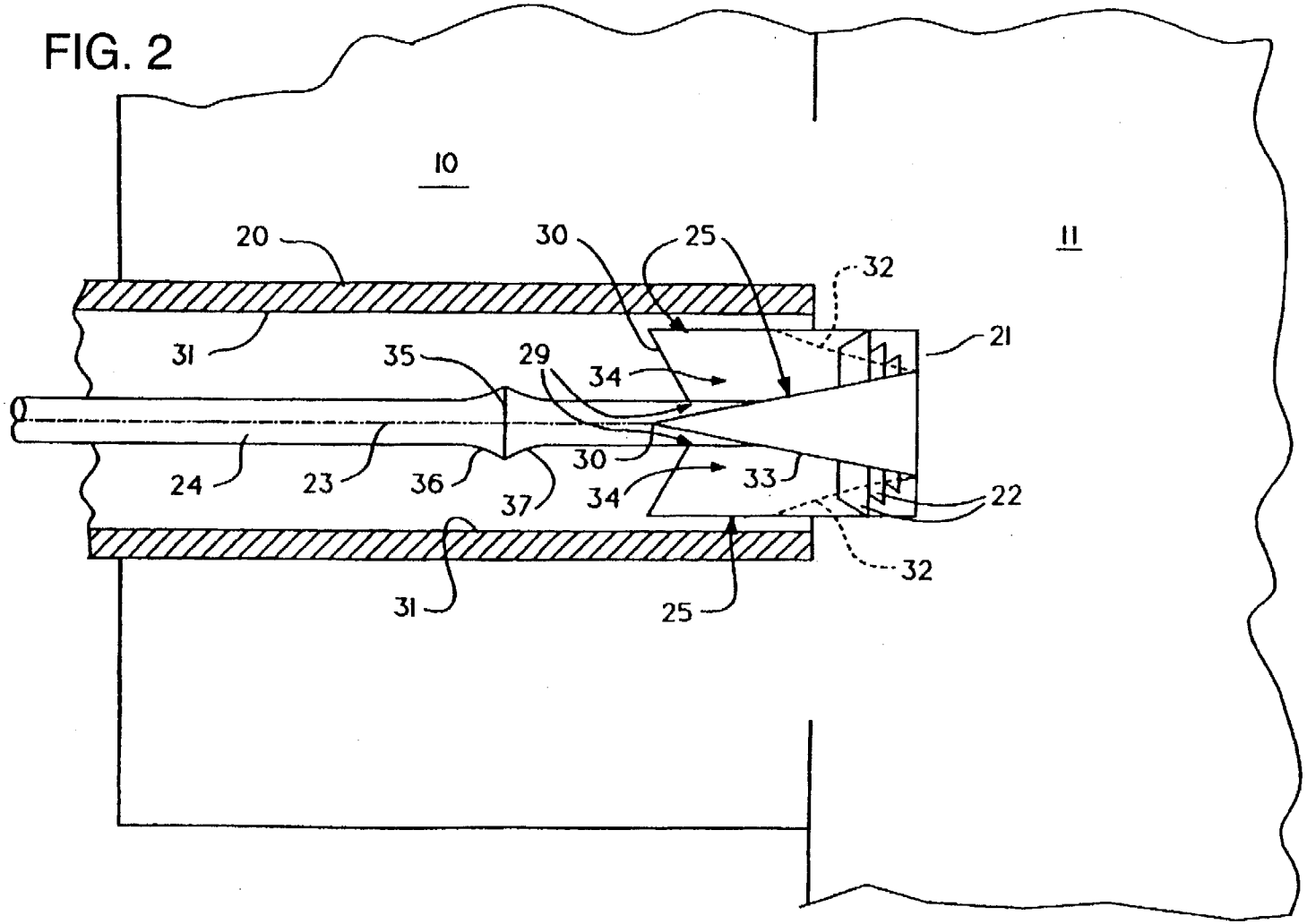
FIG. 2 is a cut-away side view of the improved coal burner of the present invention.
Figure 3:
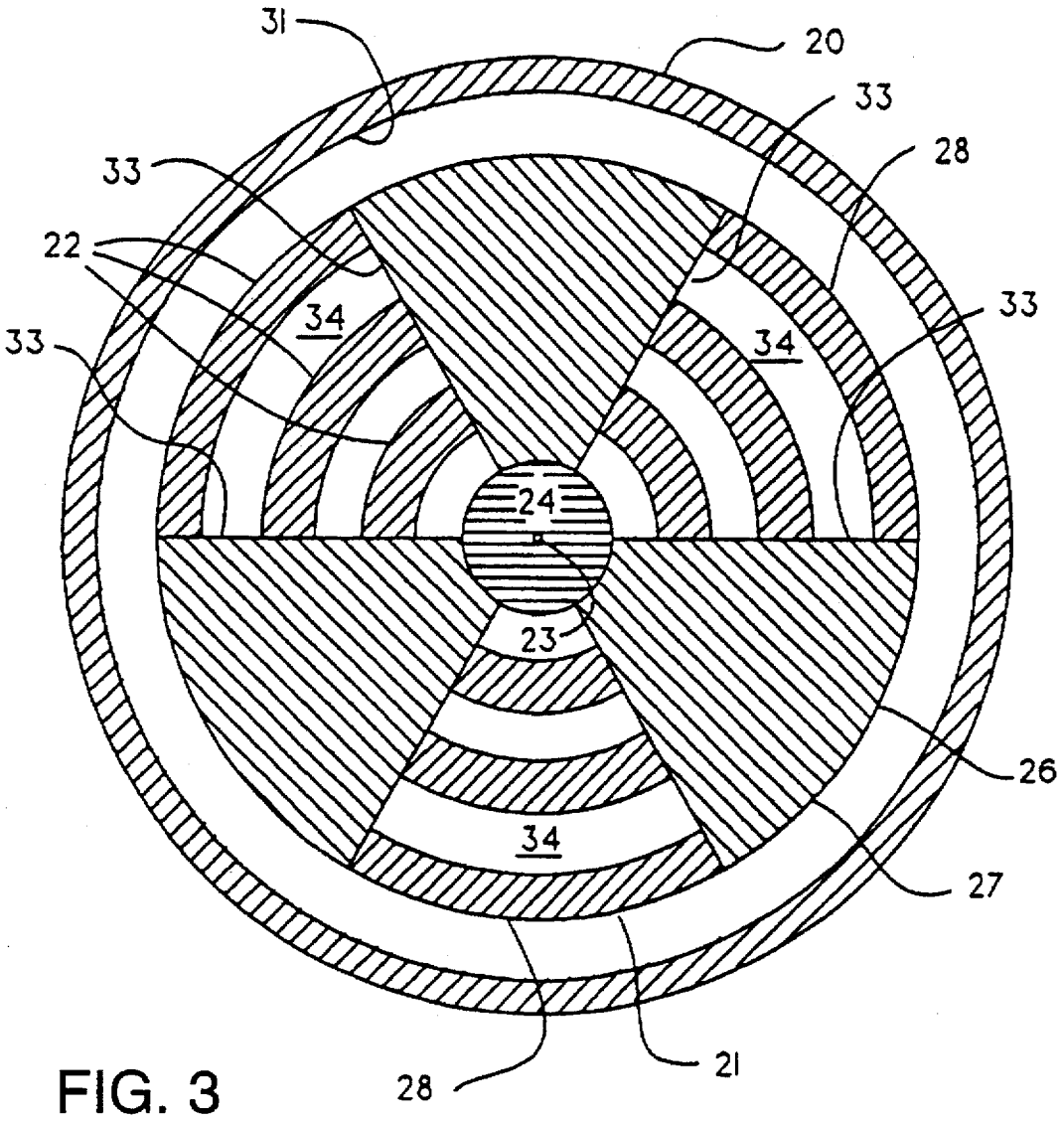
FIG. 3 is an end view of the diffuser on the improved coal burner.
Figure 4A:
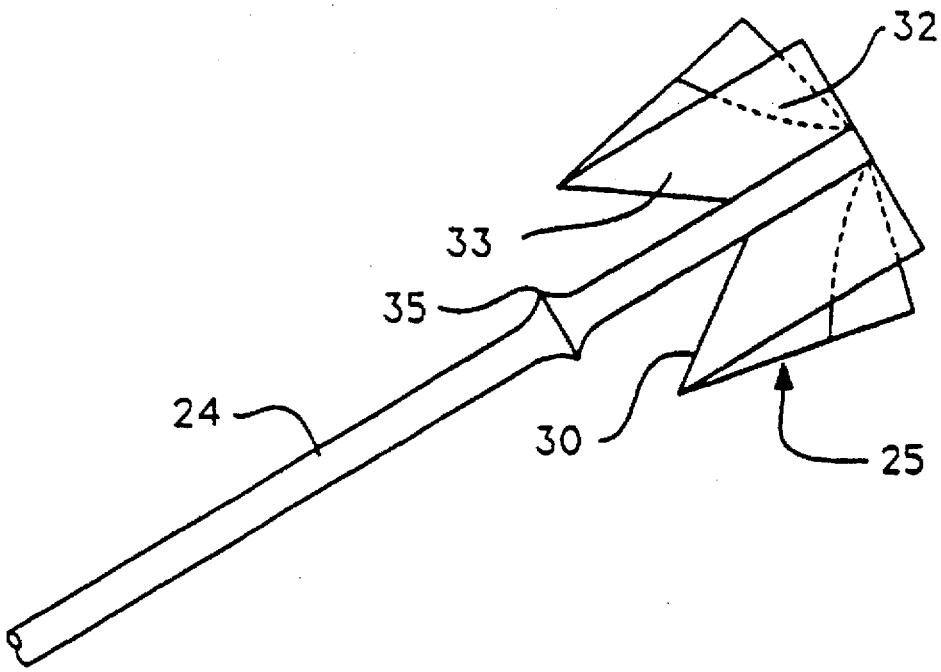
FIG. 4*a* is a perspective view, looking downstream, of the improved coal burner with the concentric rings removed for clarity.
Figure 4B:
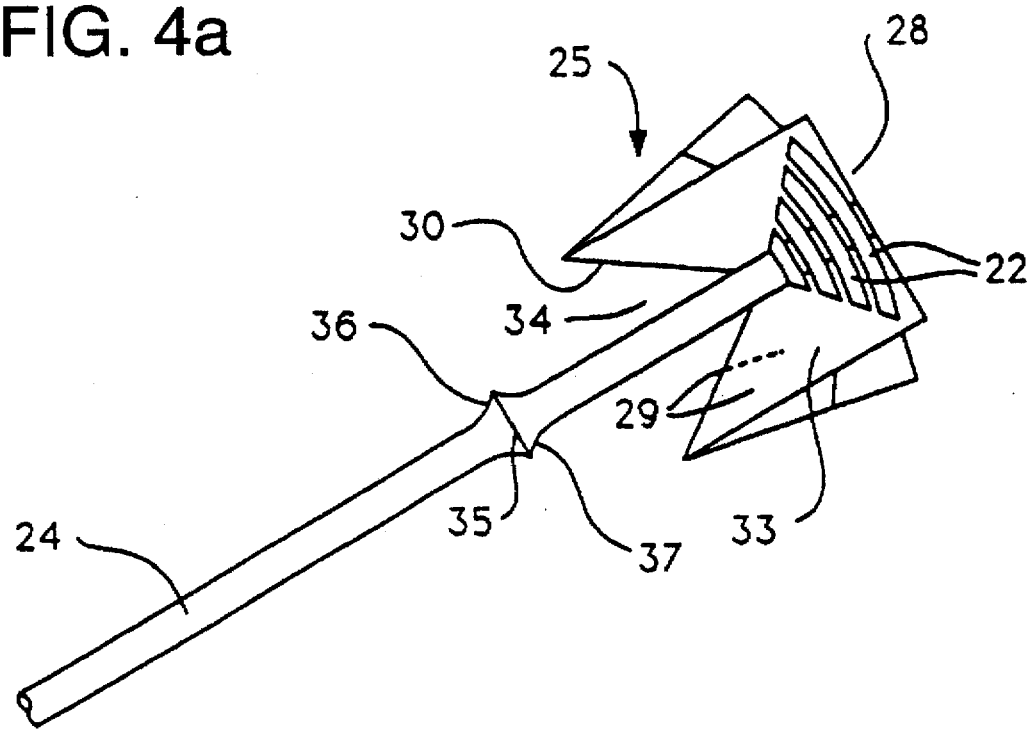
FIG. 4*b* is a perspective view, looking downstream, of the improved coal burner with the concentric rings in place.
Figure 7:
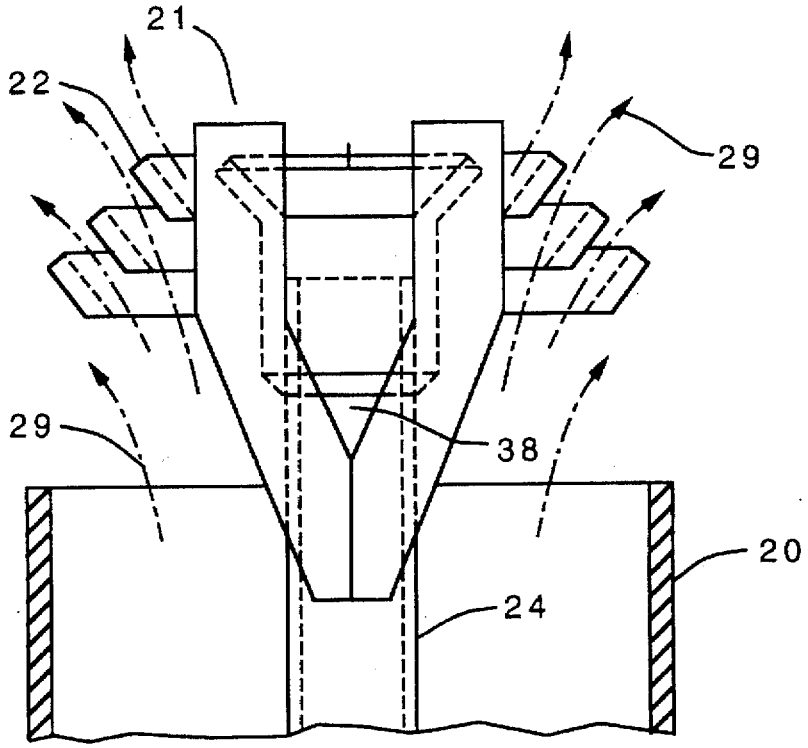
FIG. 7 is a top view of the improved coal burner of the present invention showing the conduits in the fuel splitters.
Figure 8:
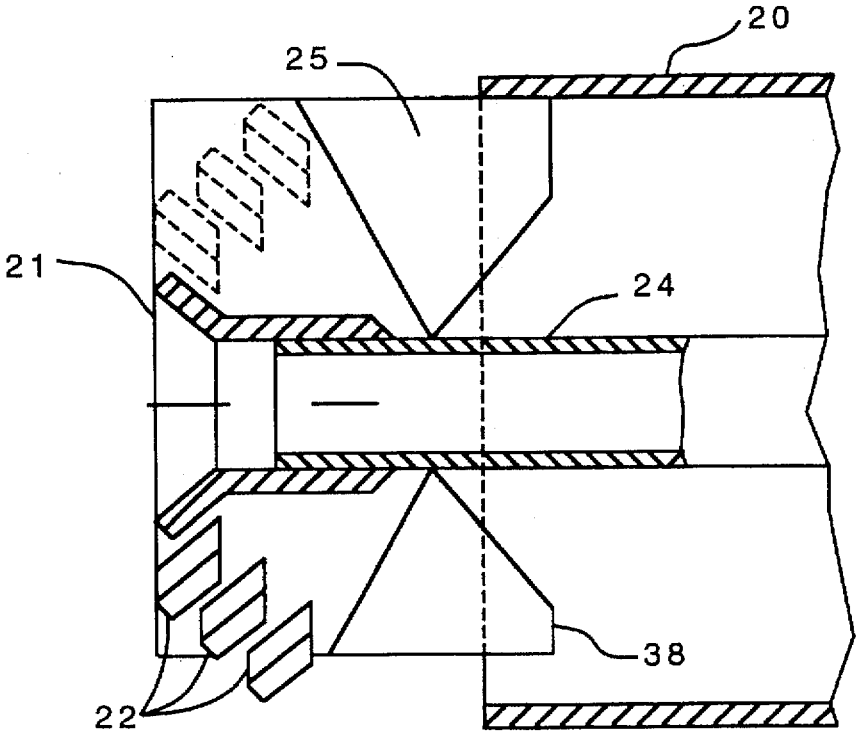
FIG. 8 is a cut-away of the side view of the improved coal burner of the present invention showing the conduits in the fuel splitters.

The present invention will best be seen and understood by way of a preferred embodiment, particularly as shown in FIGS. 1, 2, 3, 4*a*, and 4*b*, 7, 8, 9*a*, 9*b* and 10.

Referring to FIGS. 1, 2, 3, 4*a* and 4*b*, 7, 8, 9*a*, 9*b* and 10 an improved coal burner 10 for reducing the formation of NOx in a pulverized coal furnace 11 has been developed. Improved coal burner 10 causes the initial stages of combustion to take place in fuel rich zones which reduces the formation of fuel NOx from fuel bound nitrogen and reduces the formation of thermal NOx from nitrogen present in the combustion air. The operational details of the apparatus and method of the present invention are described hereafter.

In a pulverized coal combustion system employing the present invention, coal 12 is transported to pulverizer 13. Combustion air 14 is split into two streams, primary air 15 and secondary air 16. Primary air 15 flows to pulverizer 13, where it picks up pulverized coal 17, and forms a mixture of primary air and coal 18. Mixture of air and coal 18 is transported to coal burner 10 in transport pipe 19.

One component of coal burner 10 is primary-air/coal pipe 20. Primary-air/coal pipe 20 transports a mixture of air and coal 18 from transport pipe 19 to furnace 11. Diffuser 21 is positioned where primary-air/coal pipe 20 discharges mixture of air and coal 18 into furnace 11 to be burned. In the preferred embodiment, diffuser 21 comprises a plurality of concentric circular rings 22. Each ring 22 is shaped like a section from a cone. The center point of each ring 22 is located on a central longitudinal axis 23 of primary coal/air pipe 20. Along the center line of diffuser 21 is connecting rod 24 that extends into primary-air/coal pipe 20 along longitudinal axis 23. Each ring 22 is angled to deflect mixture of primary air and coal 18 away from the center of diffuser 21.

Improved coal burner 10 incorporates the addition of a plurality of aerodynamic fuel splitters 25 to each diffuser 21. A plurality of sections 26 are removed from diffuser 21 and fuel splitters 25 are placed in each removed section 26. Removed section 26 is shaped like a sector from a circle and the placement of fuel splitter 25 into removed section 26 prevents the mixture of primary air and coal 18 from flowing through this now blocked portion of diffuser 21. The placement of plurality of fuel splitters 25 create a plurality of blocked areas 27 in diffuser 21 and a plurality of partially open areas 28 in diffuser 21.

Fuel splitters 25 are shaped so that they will separate mixture of primary air and coal 18 into a plurality of streams 29. After being created, streams 29 pass through a plurality of partially open areas 28 of diffuser 21, which are not blocked by plurality of fuel splitters 25.

Leading edge 30 of fuel splitter 25 is designed to be aerodynamic and minimize turbulence created by the formation of streams 29. In one embodiment, leading edge 30 of fuel splitter 25 is shaped like the bow of a ship. The part of edge 30 nearest inside wall 31 of air/coal pipe 20 extends further into mixture of air and coal 18 than the part of edge 30 nearest longitudinal axis 23. Minimizing turbulence during the creation of streams 29 reduces the pressure drop across plurality of fuel splitters 25. In one embodiment, trailing edge 32 of fuel splitter 25 is shaped so that secondary air 16 will flow smoothly across trailing edge 32 into furnace 11 without creating eddies or causing excessive mixing of secondary air 16 with streams 29. Minimizing the creation of eddies immediately downstream of fuel splitter 25, reduces the chance of creation of a static volume of secondary air 16 downstream of fuel splitter in which an air-rich and potentially dangerous high temperature combustion zone could exist. Minimizing the immediate mixing of secondary air 16 with streams 29 prolongs the initial period in which combustion can occur in a fuel-rich environment. However, fuel splitters 25 may be shaped differently and may use a variety of cross-sectional areas, leading edge shapes, and trailing edge shapes.

Sides 33 of adjacent fuel splitters 25 form channels 34 through which streams 29 of air and coal 18 flow to partially open areas 28. Fuel splitters 25 have a combined effect of blocking about 25% to about 60% of the cross-sectional area of diffuser 21 and leaving the remaining area partially open. Streams 29 pass through partially open areas 28 in diffuser 21 and emerge into furnace 11.

In one embodiment, three fuel splitters 25 are used. In one embodiment, diffuser 21 and plurality of fuel splitters 25 can be moved axially within coal/air pipe 20 by moving connecting rod 24 either in or out. By moving fuel splitter 25 axially within coal/air pipe 20, the rate of mixing of streams 29 with secondary air 16 can be controlled. By varying this mixing, the rate of formation of NOx and combustion efficiency can be affected. In one embodiment, venturi spreader 35 is disposed axially around connecting rod 24 immediately upstream of fuel splitters 25. Venturi spreader 35 has a leading surface 36 that deflects mixture of coal and air 18 away from connecting rod 24. Venturi spreader 35 has a trailing surface 37 that is shaped to minimize the formation of eddies immediately downstream from venturi spreader 35. The outward deflection of mixture of coal and air 18 by venturi spreader 35 counteracts the tendency of fuel splitters 25 to deflect streams 29 toward the center of diffuser 21.

As shown in FIGS. 7, 8, 9*a*, 9*b* and 10, a bypass conduit 38 or 39 is embedded in each fuel splitter 25 to allow a portion of mixture of coal and air 18 to pass directly from primary-air/coal pipe 20 to furnace 11 without passing through diffuser 21. Allowing a portion of mixture of coal and air 18 to bypass diffuser 21 accomplishes two objectives. First, removing a portion of mixture of coal and air 18 diminishes the volume of each stream 29. By reducing the volume of each stream 29, the velocity of each stream 29 is reduced as it passes by rings 22 of diffuser 21. This reduction in velocity in turn reduces the rate at which each stream 29 erodes rings 22 of diffuser 21. Second, allowing a portion of mixture of coal and air 18 to travel through a bypass conduit disrupts any stationary eddies of secondary air 16 which may form adjacent to trailing edge 32 of fuel splitter 25.

Figure 9A:
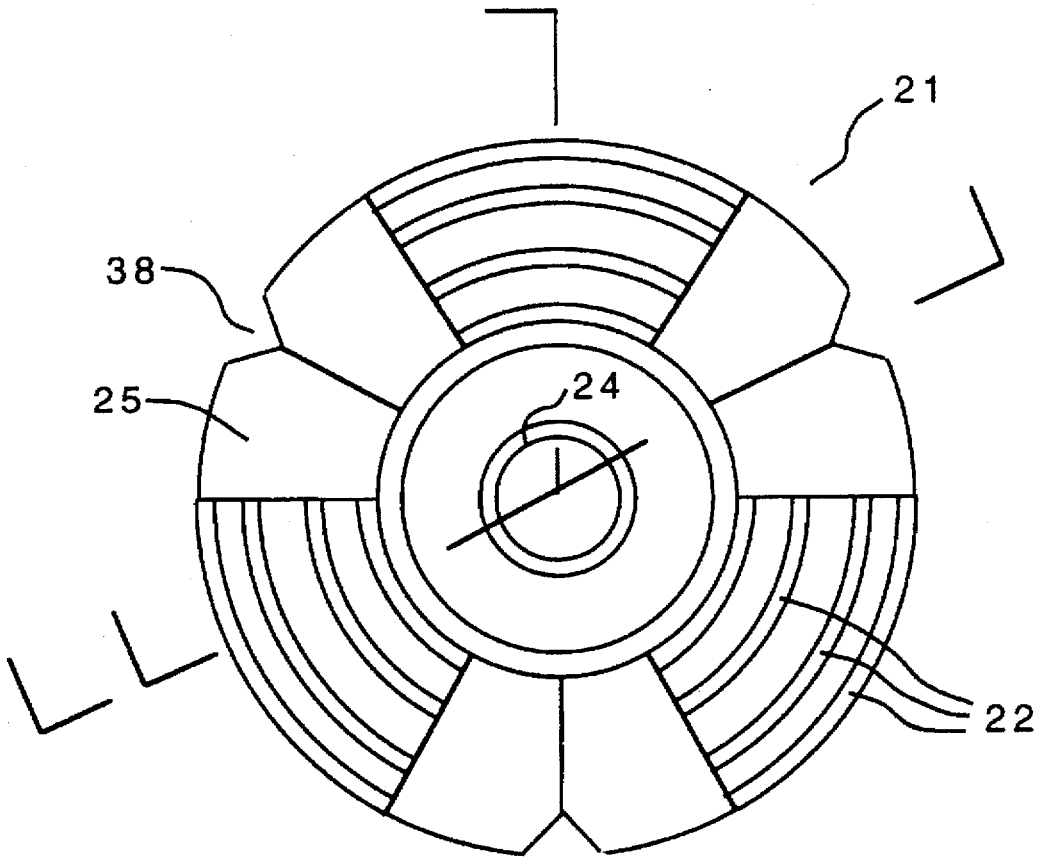
FIG. 9*a* is an end of the diffuser on the improved coal burner showing the triangular conduits in the fuel splitters.
Figure 9B:
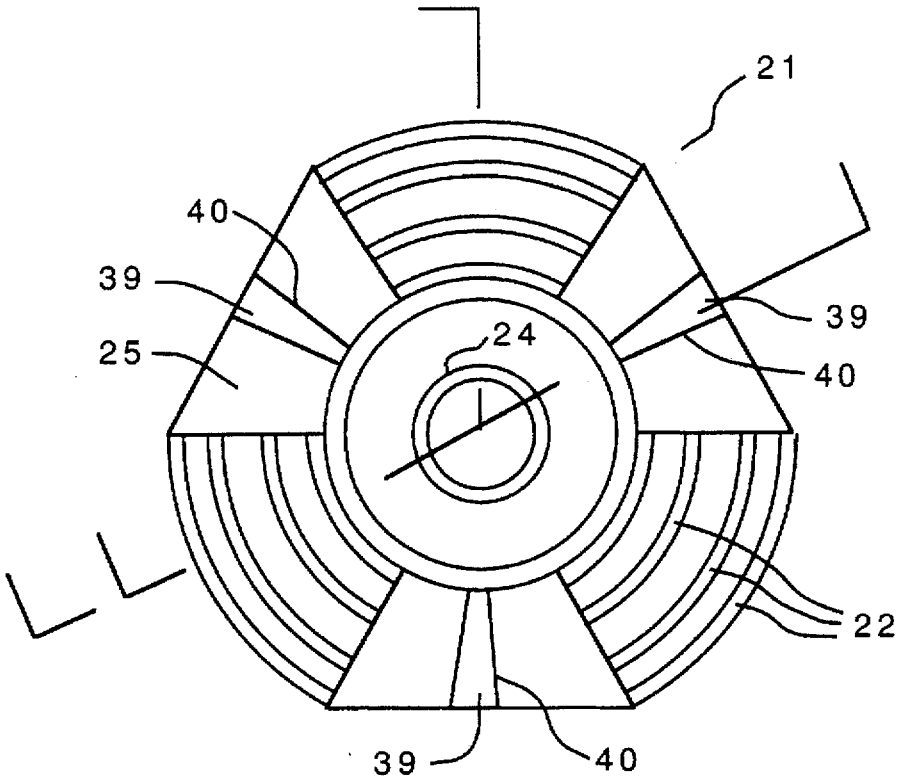
FIG. 9*b* is an end of the diffuser on the improved coal burner showing the radial conduits in the fuel splitters.
Figure 10:
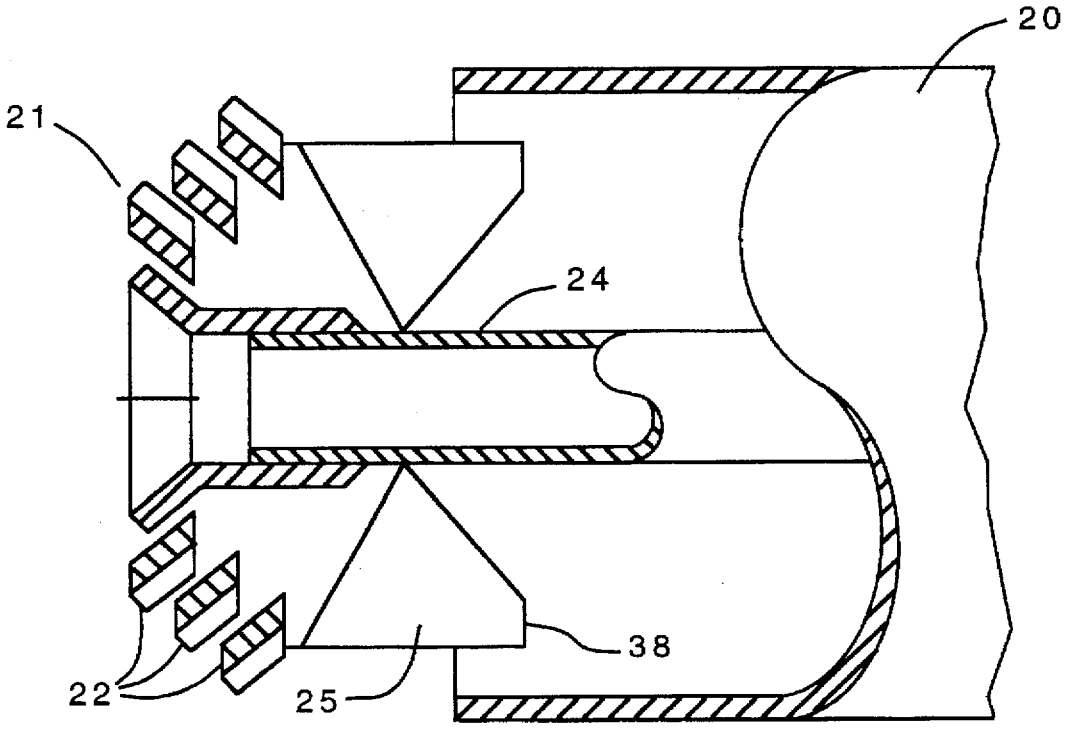
FIG. 10 is a cut-away of the side view of the improved coal burner of the present invention showing the conduits in the fuel splitters with a portion of the air-coal pipe removed for clarity.

The drawings show two variations for how a bypass conduit can be constructed. The first variation employs a bypass conduit 38 in fuel splitter 25 that provides a pathway through fuel splitter 25. In FIG. 9*a*, bypass conduit 38 is shown as a triangular shape. However, this embodiment of the present invention is not limited to any particular cross-sectional geometry so long as the conduit extends through the body of fuel splitter 25 in a manner that minimizes turbulence. Triangular shaped bypass conduit 38 can be formed by removing a portion of leading edge 30 that is closest to connecting rod 24. The size of triangular shaped bypass conduit 38 is determined by how much of stream 29 should bypass diffuser 21. The second variation employs a bypass conduit 39 within fuel splitter 25 that is a radial split in fuel splitter 25 from connecting rod 24 to inside wall 21 of air/coal pipe 20. As shown in FIG. 9*b*, in this second variation, the distance between the walls 40 of bypass conduit 39 get further apart as the distance from leading edge 30 of fuel splitter 25 increases. The radial split in fuel splitter 25 can be formed by removing a portion of leading edge 30 so that an opening from connecting rod 24 to inside wall 21 is formed. The width of this radial split is selected depending on how much of stream 29 should bypass diffuser 21.

If pulverized coal can be burned in sub-stoichiometric (fuel rich) conditions for approximately 100 to 200 milliseconds, volatile matter evolved from coal particles—which contain most of the chemically bound nitrogen—will tend to decompose or react to form molecular nitrogen. In this same high temperature region, this sub-stoichiometric combustion also limits thermal NOx formation. Preliminary field testing of modified burners indicates that NOx reductions from about 40% to about 70% may be achievable, with limited increases in combustibles in the fly ash and no discernible effect on boiler tube heat absorption or furnace slagging. Observations of the flame structure revealed that flame lengths were not noticeably longer.

It is a relatively rudimentary endeavor to achieve substantial NOx reductions if no attention is paid to various adverse effects. By reducing combustion air far enough, the rate of NOx formation will be decreased. However, slagging, fouling, and boiler tube corrosion and erosion are unwanted side-effects. Two parameters which are indicative of poor combustion and are easy to quantify are carbon monoxide concentration-hereinafter referred to as CO-in the flue gas and combustibles in the fly ash. CO in the flue gas and combustibles in the fly ash both represent an energy loss.

Some tests have been conducted in order to demonstrate the usefulness of certain embodiments of the present invention. In these tests, the NOx and in some cases the CO in the flue gas and combustibles in the fly ash have been measured.

EXAMPLES

Example 1

This example is used to establish a baseline, without employing the present invention. A wall-fired furnace used to produce steam for electrical power generation was tested. Electrical generation was 194 megawatts (hereinafter MW). Heat input to the furnace was approximately 2,000 million Btu per hour and coal consumption was nearly 100 tons per hour. The furnace has twenty pulverized coal burners on the front wall. The twenty burners are arranged in four columns which are five burners high. The lower sixteen burners are active, and are firing pulverized coal. The upper four burners are being used to admit overfire air. The unit was operated at 194 MW with the lower sixteen burners active and air only flowing through the upper elevation of four burners now regarded as overfire air ports. Secondary registers for these inactive burners were used to control the flow of overfire air. Overfire air dampers were operated at different locations from 35% to 100% open. As the overfire air damper position increased, NOx concentration decreased, CO concentration in the flue gas increased slowly but remained at acceptable levels, but combustibles in the fly ash increased to unacceptable levels when the damper position reached 55% open. The results are summarized in FIG. 5.

Example 2

The same furnace referenced in Example 1 was used again. The same coal was used. Electrical generation was 194 MW. NOx and CO emissions and combustibles in the fly ash were measured using the same equipment. In this example, four burners at the penultimate elevation were converted to a new design which is one embodiment of this invention. Since the top burners were converted to overfire air ports, the new burners were the upper most burners with coal flowing through them. Since only 4 of a total of 16 active burners were converted it can be calculated that the improvement which was measured should be no less than 25% of the total potential improvement. The second example shows that NOx could be reduced by 19% from Example 1 results when comparing the same overfire air settings. This is a significant reduction, and with more overfire air it may be possible to get under the regulatory limit of 0.5 lb of NOx per million Btu of heat input for wall-fired dry bottom furnace. This was accomplished while reducing the fly ash combustibles from approximately 10% to about 8%. The difference between 10% and 8% combustibles in the fly ash is often considered critical. The CO levels increased, but all of these CO measurements would usually be regarded as acceptable. The results are summarized in FIG. 6.

The improvement will be enhanced and NOx emissions will be further reduced by converting more burners to the new design.

While a present preferred embodiment of the invention is described herein, it is to be distinctly understood that the invention is not limited thereto but may be configured in other ways to be within the scope of the following claims.

What is claimed is:

1. An improved coal burner for the reduction of $NO_x$ emissions from furnaces that are fired with pulverized coal, said coal burner comprising:

(a) a primary air/coal pipe;

(b) a diffuser positioned where said primary air/coal pipe discharges a mixture of air and coal into a furnace; and (c) a plurality of fuel splitters defining a plurality of partially open areas and a plurality of blocked areas of said diffuser such that said plurality of fuel splitters divide said mixture of air and coal into a plurality of streams passing through said plurality of partially open areas into said furnace for combustion under initially fuel rich conditions, wherein each of said plurality of fuel splitters contains a bypass conduit that allows a portion of said mixture of air and coal to pass from a leading edge of said fuel splitter into said furnace without passing through said diffuser.

2. The invention of claim 1, wherein said bypass conduit has a triangular shaped cross-sectional area.

3. The invention of claim 1, wherein said bypass conduit is formed by a radial split in said leading edge.

4. A method for reducing the $NO_x$ in a pulverized coal-fired furnace comprising the steps of:

(a) placing a diffuser where a primary-air/coal pipe discharges a mixture of air and coal into a furnace;

(b) positioning a plurality of fuel splitters to define a plurality of partially open areas and a plurality of blocked areas of said diffuser; and (c) dividing said mixture of air and coal into a plurality of streams of air and coal to pass through said plurality of partially open areas into said furnace for combustion under initially fuel rich conditions; and (d) directing a portion of said mixture of air and coal through the interior of said fuel splitters such that it bypasses said diffusers and enters said furnace.

* * * * *